US009212480B2

(12) United States Patent
Sato

(10) Patent No.: US 9,212,480 B2
(45) Date of Patent: Dec. 15, 2015

(54) METHOD OF INSTALLING SEISMIC ISOLATION FLOOR

(71) Applicant: IDEAL BRAIN CO., LTD., Chiyoda-ku, Tokyo (JP)

(72) Inventor: Takanori Sato, Tokyo (JP)

(73) Assignee: IDEAL BRAIN CO., LTD., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/354,541

(22) PCT Filed: Sep. 21, 2012

(86) PCT No.: PCT/JP2012/006003

§ 371 (c)(1),
(2) Date: Apr. 25, 2014

(87) PCT Pub. No.: WO2013/061508

PCT Pub. Date: May 2, 2013

(65) Prior Publication Data

US 2014/0298751 A1 Oct. 9, 2014

(30) Foreign Application Priority Data

Oct. 26, 2011 (JP) ..... 2011-235408

(51) Int. Cl.
*E04B 1/98* (2006.01)
*E04F 15/18* (2006.01)
*E04H 9/02* (2006.01)

(52) U.S. Cl.
CPC . *E04B 1/98* (2013.01); *E04F 15/18* (2013.01); *E04F 15/185* (2013.01); *E04H 9/02* (2013.01)

(58) Field of Classification Search
USPC ..... 52/167.1, 167.4, 167.5, 167.9
See application file for complete search history.

(56) References Cited

U.S. PATENT DOCUMENTS

| | | | | | |
|---|---|---|---|---|---|
| 951,028 | A * | 3/1910 | Schar | ..... | 52/167.5 |
| 2,002,934 | A * | 5/1935 | Collins | ..... | 52/167.5 |
| 2,014,643 | A * | 9/1935 | Bakker | ..... | 384/49 |
| 5,261,200 | A * | 11/1993 | Sasaki et al. | ..... | 52/167.5 |
| 7,536,835 | B2 * | 5/2009 | Schluter | ..... | 52/390 |
| 2009/0094906 | A1 * | 4/2009 | Sato | ..... | 52/167.4 |

FOREIGN PATENT DOCUMENTS

| | | | | | |
|---|---|---|---|---|---|
| JP | 9-317029 | A | | 12/1997 | |
| JP | 10-317658 | A | | 12/1998 | |
| JP | 2001-132210 | A | | 5/2001 | |
| JP | 2001132210 | A | * | 5/2001 | ..... E04F 15/00 |
| JP | 2002-30791 | A | | 1/2002 | |
| JP | 2008-116039 | A | | 5/2008 | |
| JP | 2010-127455 | A | | 6/2010 | |

OTHER PUBLICATIONS

International Search Report (ISR) dated Oct. 16, 2012 (and English translation thereof) issued in International Application No. PCT/JP2012/006003.

* cited by examiner

*Primary Examiner* — Brian Glessner
*Assistant Examiner* — Adam Barlow
(74) *Attorney, Agent, or Firm* — Holtz, Holtz, Goodman & Chick PC

(57) ABSTRACT

A method of installing a base isolation floor includes a base arrangement process for installing a plurality of plate-shaped bases, which are formed so that a plurality of upward convex curved surface portions are aligned on an upper surface, on double-sided tapes applied onto an upper surface of a floor over a plurality of columns to be substantially parallel to each other and thereby arranging the bases on the upper surface of the floor and a slide plate installation process for installing a plurality of plate-shaped slide plates having a substantially flat lower surface on the base.

25 Claims, 20 Drawing Sheets

LUBRICANT IS COATED ON PORTIONS OTHER THAN CONTACT POINTS

SANDBLASTING IS APPLIED TO CONTACT POINTS, AND LUBRICANT IS COATED ON WHOLE SURFACE

THE SAME TYPE OF CURVED SURFACES ($h \leq H$), AND LUBRICANT IS COATED ON WHOLE SURFACE HOLED PLANES ($r \leq R$), AND LUBRICANT IS COATED ON WHOLE SURFACE

METHOD OF INSTALLING SEISMIC ISOLATION FLOOR

TECHNICAL FIELD

The present invention relates to a method of installing a base isolation floor, which is suitably installed for effectively exercising a base isolation function even in a case where massive vibration due to earthquake is generated in a building and a civil engineering structure.

BACKGROUND ART

As a conventionally proposed indoor base isolation floor structure of a building and the like, as shown in Patent Literature 1, for example, there has been proposed a base isolation floor in which a plurality of ball bearings are fixed to a frame to thereby make the flame movable on a floor slab. In the technique disclosed by the Patent Literature 1, the ball bearings are arranged particularly in a lower portion of a metal pipe, whereby even if an earthquake load acts, since the rolling friction resistance of the ball bearing is small, the vibration is hardly transmitted to the base isolation floor.

Further, as disclosed in Patent Literature 2, there has been proposed a base isolation floor in which an upper plate and a lower plate provided with a plurality of grooves are installed between a floor material and precision equipment and the like, and balls in the grooves are rotated to make the upper plate movable on the lower plate. In the technique disclosed by the Patent Literature 2, even if the earthquake load acts, since the rolling friction resistance of the balls in the grooves is small, the vibration is hardly transmitted to the precision equipment and the like on the upper plate.

CITATION LIST

Patent Literatures

Patent Literature 1: JP 10-317658 A
Patent Literature 2: JP 2010-127455 A

SUMMARY OF INVENTION

Technical Problem

However, the base isolation floor disclosed in the Patent Literature 1 has a structure in which the bearing is attached to a square pipe with bolts and nuts. Thus, in the base isolation floor disclosed in the Patent Literature 1, the thickness of the entire base isolation structure is increased by the thickness of the square pipe and the like, so that the height of a floor surface is increased. When the height of the floor surface is unnecessarily large, there occurs a problem that an effective space in a building and the like is narrowed accordingly.

The base isolation floor disclosed in the Patent Literature 2 is installed between a floor material and precision equipment and the like. Thus, when the base isolation floor is installed with respect to existing precision equipment and the like, the precision equipment and the like are temporarily removed to be moved to another place, and after the base isolation floor is installed, the removed precision equipment and the like are required to be installed to an original position again. Thus, there are problems of an increase in a burden of installation labor and an increase in installation cost.

Meanwhile, in the base isolation floor disclosed in the Patent Literature 2, due to an unexpected large earthquake motion, when the upper plate is moved until the position of the ball reaches an end of the groove, the ball and the end of the groove collide with each other, whereby the movement of the upper plate is suddenly stopped at the end of the groove, and there is a problem that the precision equipment and the like on the upper plate may be overturned by the action of inertia.

Thus, the present invention is devised in view of the above problems, an object of the invention is to provide a method of installing a base isolation floor which can effectively utilize an effective space in a building and the like by reducing the thickness of the entire base isolation structure, at the same time, can eliminate the fear of overturning precision equipment and the like because a head drop is small even if the base isolation floor is protruded by an unexpected large earthquake motion, and can reduce installation labor and installation cost.

Solution to Problem

In order to solve the above problems, as a result of intensive studies, the present inventor invented the following method of installing a base isolation floor.

A method of installing a base isolation floor according to a first invention includes a base arrangement process for installing a plurality of plate-shaped bases, which are formed so that a plurality of upward convex curved surface portions are aligned on an upper surface, on double-sided tapes applied onto the floor surface over a plurality of columns to be substantially parallel to each other and thereby arranging the bases on the floor surface and a slide plate installation process for installing a plurality of plate-shaped slide plates having a substantially flat lower surface on the base so that the slide plates are moved on the base by an earthquake motion, the slide plates are dropped from above the base, and the slide plates are moved on a floor surface around the base by inertia to be decelerated, and, thus, to stop.

A method of installing a base isolation floor according to a second invention includes a base arrangement process for installing a plurality of plate-shaped bases, which are formed so that a plurality of upward convex curved surface portions are aligned on an upper surface, on an adhesive layer coated onto the floor surface and thereby arranging the bases on the floor surface and a slide plate installation process for installing a plurality of plate-shaped slide plates having a substantially flat lower surface on the base so that the slide plates are moved on the base by an earthquake motion, the slide plates are dropped from above the base, and the slide plates are moved on a floor surface around the base by inertia to be decelerated, and, thus, to stop.

A method of installing a base isolation floor according to a third invention includes a base arrangement process for installing plate-shaped bases, which are formed so that a plurality of upward convex curved surface portions are aligned on an upper surface, on a nonslip sheet having a friction coefficient larger than that of the floor surface and a slide plate installation process for installing a plurality of plate-shaped slide plates having a substantially flat lower surface on the base so that the slide plates are moved on the base by an earthquake motion, the slide plates are dropped from above the base, and the slide plates are moved on a floor surface around the base by inertia to be decelerated, and, thus, to stop.

A method of installing a base isolation floor according to a fourth invention includes a base arrangement process for installing plate-shaped bases, which are formed so that a plurality of upward convex curved surface portions are aligned on an upper surface, on a nonslip sheet having a friction coefficient larger than that of the floor surface, a slide plate installation process for installing a plurality of plate-shaped slide plates having a substantially flat lower surface on the base so that the slide plates are moved on the base by an earthquake motion, the slide plates are dropped from above the base, and the slide plates are moved on a floor surface around the base by inertia to be decelerated, and, thus, to stop, and an insertion process for pulling a nonslip sheet while holding an end of the nonslip sheet to move the nonslip sheet while sliding the nonslip sheet on the floor surface, inserting the base and the slide plate, installed on the nonslip sheet, in between the floor surface and a bottom portion of equipment, and installing the equipment on the inserted slide plate.

In a method of installing a base isolation floor according to a fifth invention, in the base arrangement process in the first invention, the floor surface is heated by a heating roller for preheating arranged forward under a room temperature of not more than 0° C. and, at the same time, a double-sided tape is applied by using a roller for use in a refrigerating chamber capable of press-fitting the double-sided tape onto a floor surface, heated by the heating roller for preheating, with a heating roller for press-fitting arranged backward.

In a method of installing a base isolation floor according to a sixth invention, in any one of the first to fifth inventions, the base has a thickness of 1.5 mm.

In a method of installing a base isolation floor according to a seventh invention, in any one of the first to sixth inventions, a lower surface of the slide plate is coated with a lubricant at a portion not abutted against the convex curved surface portion of the base in such a state that the slide plate is installed on the base.

In a method of installing a base isolation floor according to an eighth invention, in any one of the first to seventh inventions, in the slide plate installation process, after a plurality of the slide plates are installed on the base, a thick plate is installed on the slide plate.

In a method of installing a base isolation floor according to a ninth invention, in any one of the first to eighth inventions, in the slide plate installation process, after a plurality of the slide plates are installed on the base, the base and a peripheral edge of the slide plate are sealed, and air of a gap between the base and the slide plate is replaced with an inert gas.

A method of installing a base isolation floor according to a tenth invention in any one of the first to ninth inventions includes an OA floor installation process for installing a plurality of support members on the plurality of slide plates installed on the base without connecting the support members mutually, installing a floor material on the plurality of support members, and forming a gap between the slide plate and the floor material.

Advantageous Effects of Invention

According to the first to ninth inventions, since a base isolation floor can be installed by a thin plate-shaped base and a slide plate, the base isolation floor can be easily introduced, and, at the same time, the height of the floor surface is reduced, so that an effective space in a building and the like can be widened.

DESCRIPTION OF EMBODIMENTS

Hereinafter, embodiments for practicing a method of installing a base isolation floor to which the present invention is applied will be described in detail with reference to the drawings.

Figure 1:
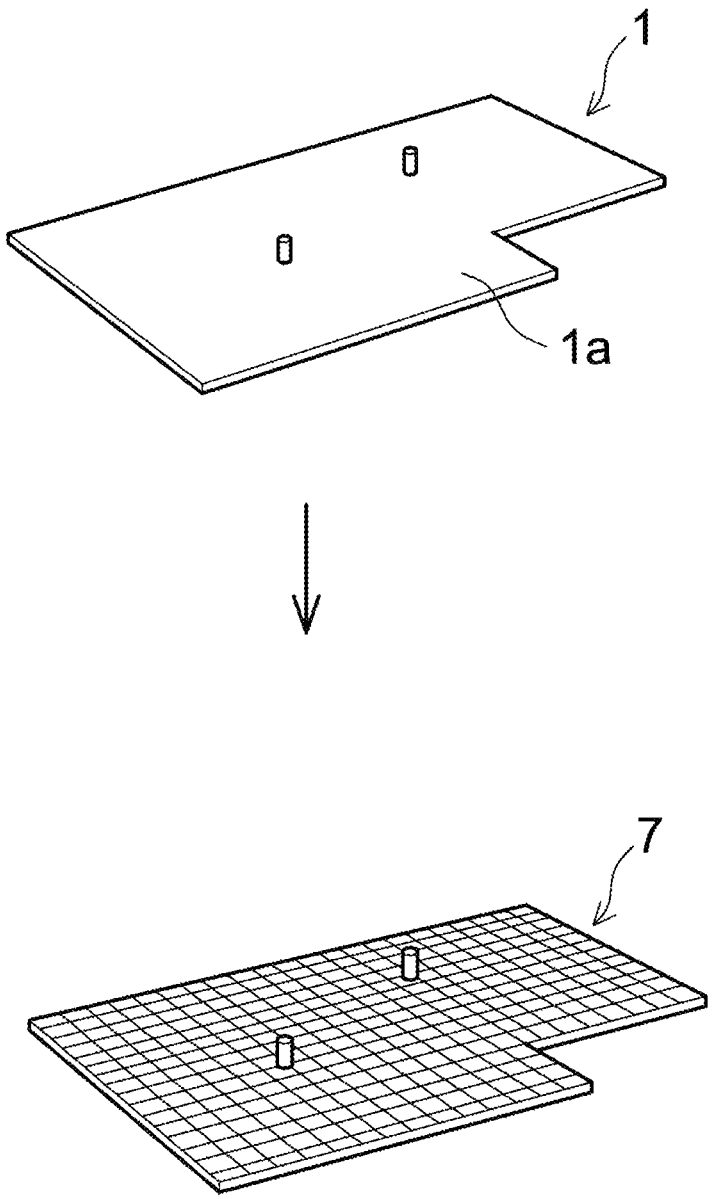
FIG. 1 is a basic schematic diagram of a method of installing a base isolation floor to which the present invention is applied.

In the method of installing a base isolation floor to which the present invention is applied, a base isolation floor 7 is installed on an upper surface 1*a* of a floor 1, as shown in FIG. 1.

Figure 2A:
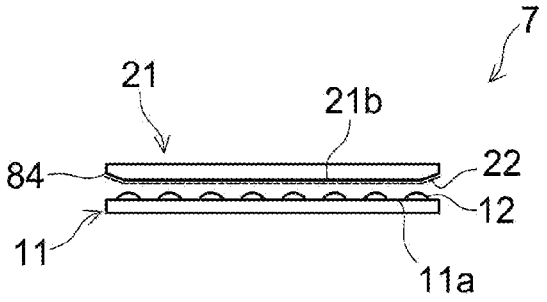
FIG. 2A is a side view of the base isolation floor as viewed from the side.
Figure 2B:
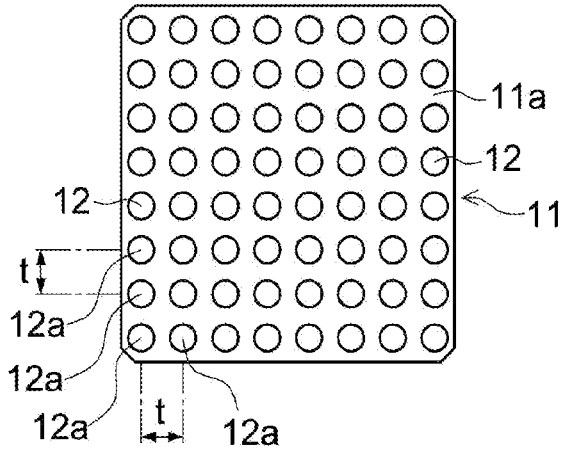
FIG. 2B is a plan view of a base as viewed from above.

FIG. 2A is a side view of the base isolation floor 7 as viewed from the side. The base isolation floor 7 is provided with a base 11 and a slide plate 21 installed on the base 11, as shown in FIG. 2A. FIG. 2B shows a plan view of the base 11 as viewed from above. The base 11 is formed into a substantially square flat plate shape whose four corners are chamfered in order to secure play of installation accuracy, and a plurality of convex curved surface portions 12 are regularly arranged on an upper surface portion 11*a* on the slide plate 21 side. Although the base 11 is configured such that each of the four sides of the substantially square shape has a length of about 500 mm and a thickness of about 1.5 mm, the configuration is not limited thereto, and the base 11 may have any size. Although the base 11 is made of metal and preferably stainless steel, the material is not limited thereto, and the base 11 may be made of glass, resin, or any material. The base 11 may be coated with a coat having a predetermined physicality in order to control the friction coefficient or prevent corrosion. In the adjustment of the friction coefficient of a surface of the base 11, a surface layer of at least the convex curved surface portion 12 may be covered with a hard material such as metal and ceramics, or a surface hardening treatment such as carburizing treatment and boronizing may be additionally applied to control the surface roughness, whereby the friction coefficient of the surface of the base 11 may be adjusted.

Figure 3A:
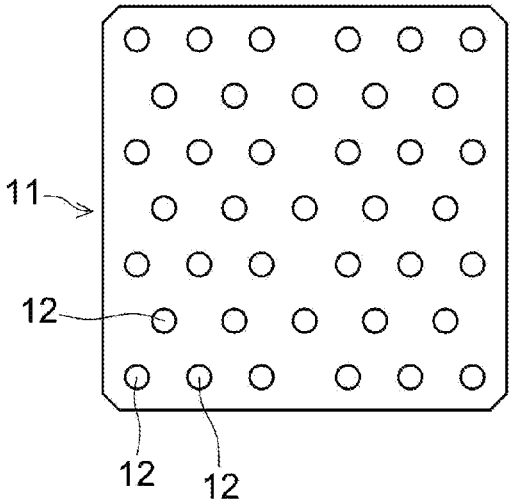
FIGS. 3A-3C are views for explaining an arrangement position of convex curved surface portions.
Figure 3B:
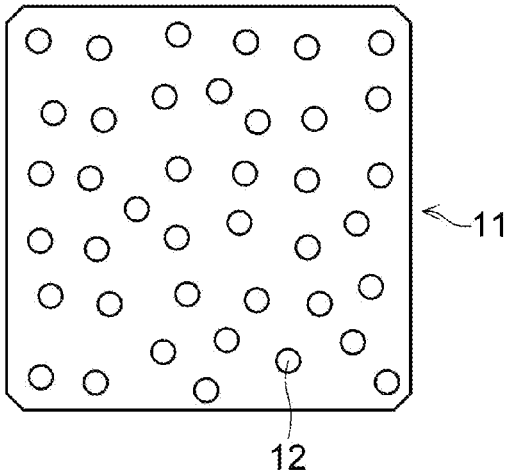
Figure 3C:
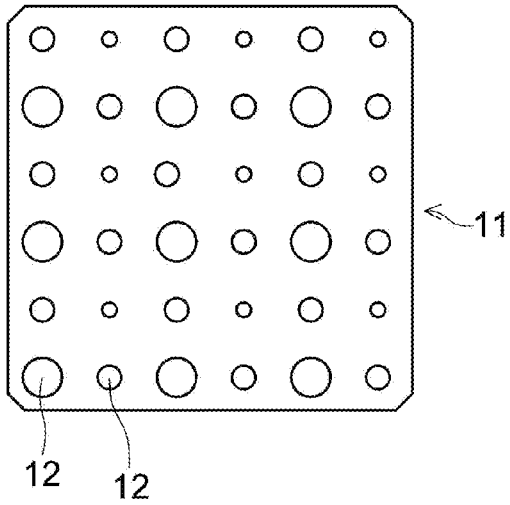

Moreover, an interval t between top portions 12*a* of the convex curved surface portions 12 adjacent to each other may be about 25 mm. In the present invention, the interval t is preferably 5 mm to 100 mm. The interval t is an interval requiring elimination of dust and wastes, an interval suitable for manufacturing by press molding, or an interval determined by an allowable loading capacity. Although the convex curved surface portion 12 is preferably configured to have a substantially circular shape as shown in FIG. 2B, the shape is not limited thereto. Although the convex curved surface portions 12 may be regularly aligned vertically and horizontally in plan view, this invention is not limited thereto, and as shown in FIG. 3A, the curved surface portions 12 may be formed into a zigzag shape. The convex curved surface portions 12 may be irregularly formed as shown in FIG. 3B, or the convex curved surface portions 12 having different sizes maybe formed by being aligned regularly as shown in FIG. 3C.

Figure 2C:
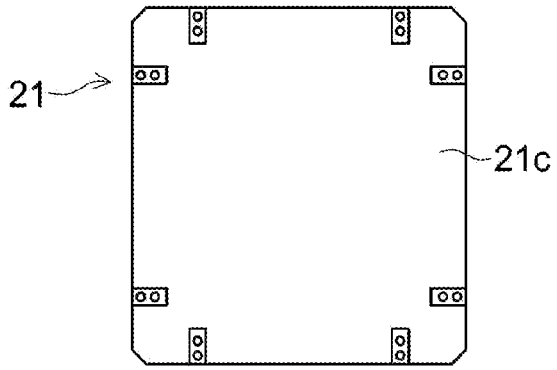
FIG. 2C is a plan view of a slide plate as viewed from above.

FIG. 2C is a plan view of the slide plate 21 as viewed from above. The slide plate 21 is formed into a substantially square flat plate shape whose four corners are chamfered. In the slide plate 21, the four sides of the substantially square shape have a length of about 500 mm and a thickness of about 1.6 mm. The slide plate 21 according to the present invention is not limited thereto and may be configured to be larger than the base 11 or may be configured to have any size. The slide plate 21 may be formed of metal, glass, resin, or the like, and stainless steel may be used in only the surface layer.

Figure 4A:
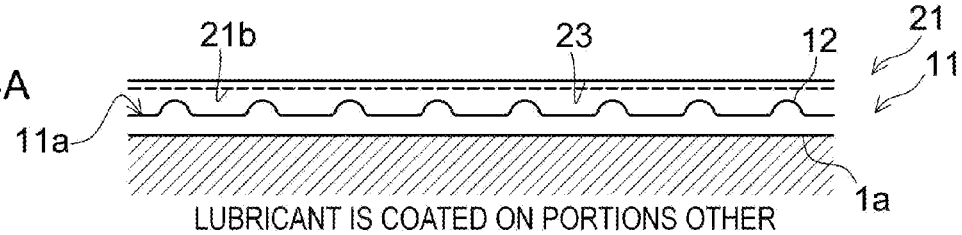
FIGS. 4A-4D are enlarged views showing an abutment portion of an upper surface portion of the base and a lower surface portion of the slide plate.

FIG. 4A is an enlarged view showing an abutment portion of an upper surface portion 11*a* of the base 11 and a lower surface portion 21*b* of the slide plate 21. In the slide plate 21, a concave curved surface portion 22 and a through-hole 22*a* are not formed, the lower surface portion 21*b* is made substantially flat, and a sliding portion 23 which is a portion other than an abutment portion with the convex curved surface portion 12 can be coated with a lubricant. The lubricant is represented by grease, tetrafluoroethylene resin, and silicon resin and can reduce the friction coefficient to enhance the sliding property. The lubricant may be mixed with a powder having a particle size of 1 μm to 50 μm, such as diamond and may have a viscosity not less than 100 cst, such as silicon oil, grease, heavy fuel oil, and wax.

Figure 4B:
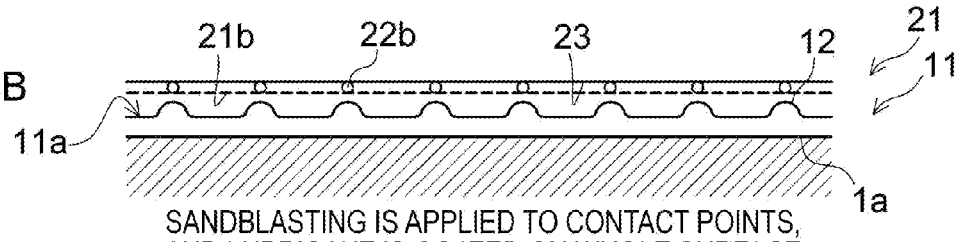

In the slide plate 21, as shown in FIG. 4B, the lower surface portion 21*b* is substantially flat, and the abutment portion with the convex curved surface portion 12 is subjected to sandblasting, for example, whereby high friction portions 22*b* having a large friction coefficient are formed, and the sliding portion 23 may be coated with the above lubricant. The sliding portion 23 may be coated with a lubricant (not shown) such as grease, tetrafluoroethylene resin, and silicon resin, as shown in FIG. 4B. Namely, in the embodiment of FIG. 4B, the high friction portions 22*b* having a large friction coefficient are provided just at the abutment portion with the convex curved surface portion 12, and a lubricant having a small friction coefficient is coated onto a portion other than the abutment portion with the convex curved surface portion 12, whereby both the power of resistance until reaching the start of sliding according to the slide plate 21 and the sliding property after the start of sliding can be freely adjusted. According to this constitution, it is possible to provide an ideal base isolation device which does not easily move even if incorrectly pushed by an operator by mistake in normal times and smoothly moves when shifted from the abutment position due to occurrence of a large earthquake to exercise a base isolation performance.

Figure 4C:
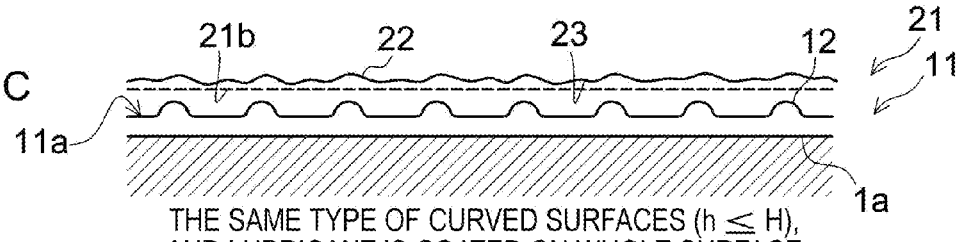
Figure 4D:
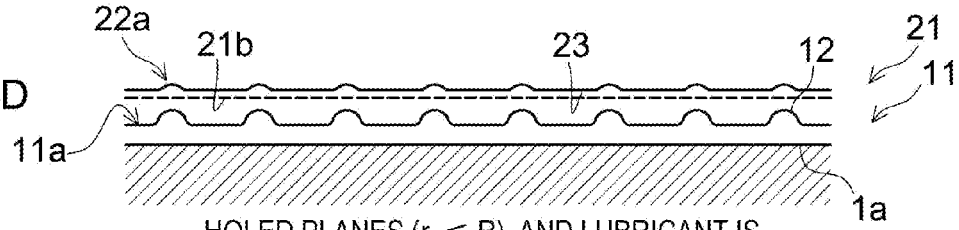

In the slide plate 21, as shown in FIG. 4C, the base 11 may be able to be abutted against the slide plate 21 from the lower side through the lower surface portion 21*b*. More specifically, in the lower surface portion 21*b*, a plurality of the concave curved surface portions 22 are regularly aligned. Namely, the alignment position of the concave curved surface portions 22 corresponds to the alignment position of the convex curved surface portions 12 in plan view, and the slide plate 21 is installed on the base 11, whereby the concave curved surface portions 22 are provided to be located on the convex curved surface portion 12 in the base 11. It should be noted that the slide plate 21 is not limited to this form, and instead of the concave curved surface portions 22, the through-holes 22*a* may be formed to correspond to the alignment position of the convex curved surface portions 12 in plan view, as shown in FIG. 4D.

Figure 5A:
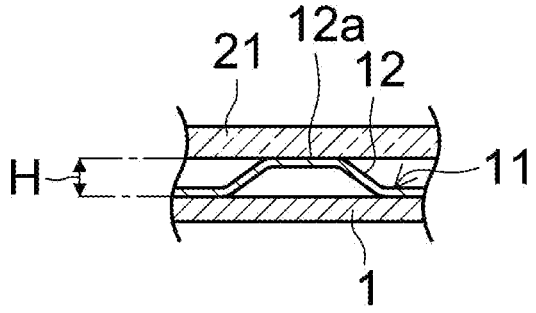
FIGS. 5A-5D are views for explaining details of the convex curved surface portion.
Figure 5B:
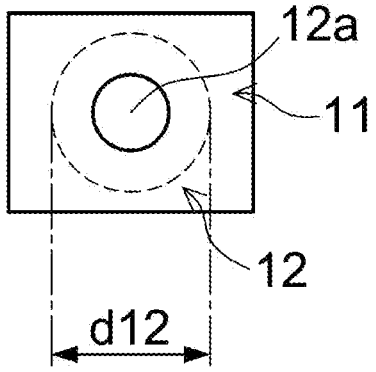
Figure 5C:
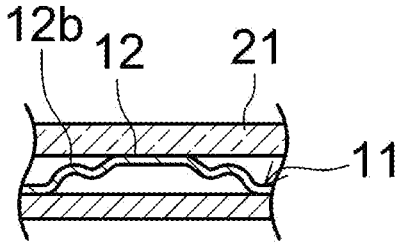
Figure 5D:
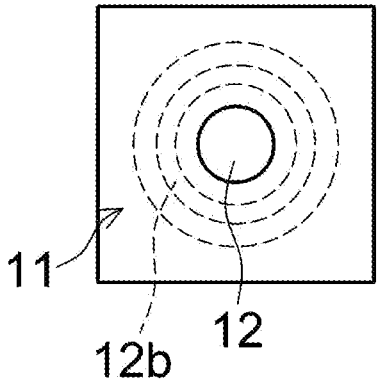
Figure 6A:
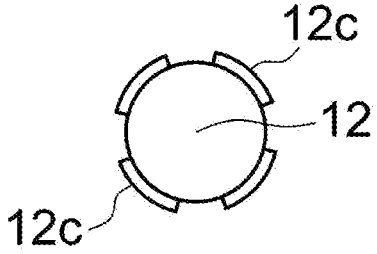
FIGS. 6A and 6B are views showing an example in which an intermittent slit is formed along a circumferential direction of the convex curved surface portion.
Figure 6B:
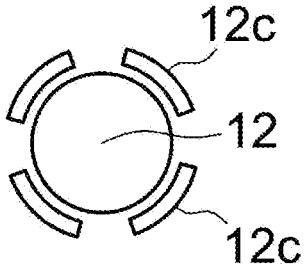

FIG. 5A is a cross-sectional view of the convex curved surface portion 12 as viewed from the side in this example. FIG. 5B is a plan view of the convex curved surface portion 12 as viewed from above in this example. In this example, as shown in FIG. 5A, the convex curved surface portion 12 is formed by press working and the like so that a diameter $d_{12}$ of the convex curved surface in plan view is about 10 mm, a curvature radius r of the top portion 12*a* is about 30 mm, and a height H is about 1.0 mm. Although there is no particular limitation on the curvature constituting the convex curved surface portion 12, a top surface is particularly adjusted so that the curvature is gentle, whereby a contact area with the concave curved surface portion 22 is increased, and the sliding property may be improved. The invention is not limited to this example, and, as shown in FIGS. 5C and 5D, a substantially circular raised portion 12*b* may be formed outside of the concentric circle of the convex curved surface portion 12 in plan view. By virtue of the provision of the raised portion 12*b*, flexibility (spring property) is provided in the vertical direction, so that unevenness of the floor surface (poor plane precision) can be absorbed. The convex curved surface portion 12 may have intermittent slits 12*c* formed along a circumferential direction in plan view of the convex curved surface portion 12, as shown in FIGS. 6A and 6B. The slit 12*c* may be penetrated or may be constituted of a non-through groove. By virtue of the provision of the slit 12*c*, an internal stress produced when a large number of the convex curved surface portions 12 are press-molded can be released to a seamless steel plate, and the plane precision of the steel plate concerned can be secured.

Figure 7A:
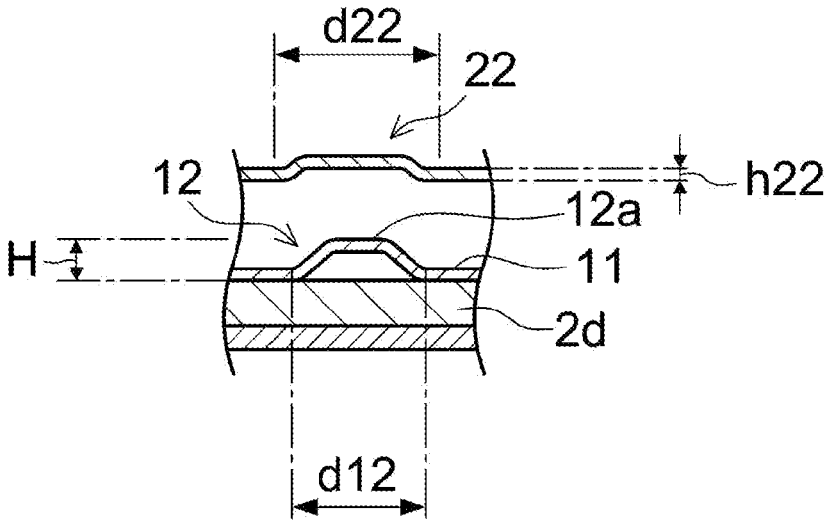
FIGS. 7A and 7B are cross-sectional views of the convex curved surface portion or a through-hole as viewed from the side.

FIG. 7A is a cross-sectional view of the concave curved surface portion 22 as viewed from the side in this example. The concave curved surface portion 22 shown in FIG. 4C has the same curvature radius as the top portion 12*a* of the convex curved surface portion 12, as shown in FIG. 7A; however, this invention is not limited thereto, the concave curved surface portion 22 may have the larger curvature radius . A depth $h_{22}$ of the concave curved surface portion 22 is smaller than the height H of the top portion 12*a* of the convex curved surface portion 12, and the concave curved surface portion 22 is formed by press working and the like to have a depth of 0.05 mm to 0.50 mm. Moreover, a diameter $d_{22}$ of the concave curved surface portion 22 is preferably not less than the diameter $d_{12}$ of the convex curved surface portion 12 so that the top portion 12*a* of the convex curved surface portion 12 is abuttable against the inside of the concave curved surface portion 22.

Figure 7B:
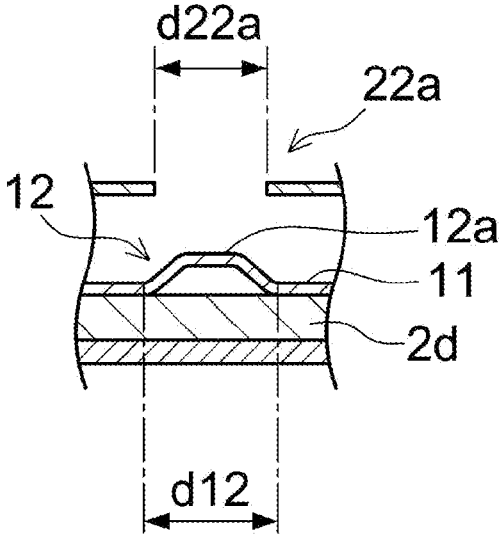

FIG. 7B is a cross-sectional view of the through-hole 22*a* as viewed from the side in another example. The through-holes 22*a* shown in FIG. 4D are formed using a punching tool such as a punch while the diameter $d_{22a}$ is smaller than the diameter $d_{12}$ of the convex curved surface portion 12 so that only the top portion 12*a* of the convex curved surface portion 12 is fitted into the through-hole 22*a*. When the convex curved surface portion 12 is constituted of a planar substantially circular shape, the through-hole 22*a* is constituted of a planar substantially circular shape in accordance with the shape of the convex curved surface portion 12, whereby the convex curved surface portion 12 can be fitted into the through-hole 22*a* in such a state that both of them are stable.

Next, details of a method of installing a base isolation floor 7 to which the present invention is applied will be described along with the basic concept.

Figure 8A:
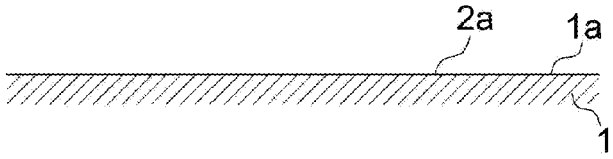
FIGS. 8A-8F are views for explaining a method of installing a base isolation floor to which the present invention is applied.
Figure 8B:
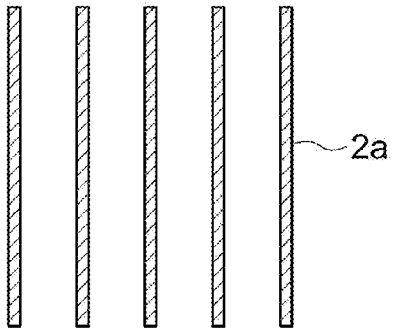

In the method of installing the base isolation floor 7 to which the present invention is applied, in this example, as shown in FIGS. 8A and 8B, double-sided tapes 2*a* are first applied in parallel onto the upper surface 1*a* of the floor 1 at intervals of the length of one side of the base 11 so as to be substantially parallel to each other. The double-sided tapes 2*a* are applied substantially parallel to each other, whereby since a portion at which the double-sided tapes 2*a* overlap is not generated in comparison with a case where the double-sided tapes are applied in a lattice shape, it is possible to prevent from causing an unstable state when the base isolation floor 7 is installed on the overlapping double-sided tapes 2*a*. In the method of installing the base isolation floor 7 to which the present invention is applied, in another example, instead of the double-sided tape 2*a*, a seal material such as an emulsion based adhesive is coated onto the upper surface 1*a* of the floor 1, whereby an adhesive layer can be formed.

Figure 8C:
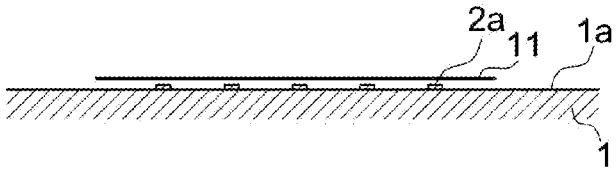
Figure 8D:
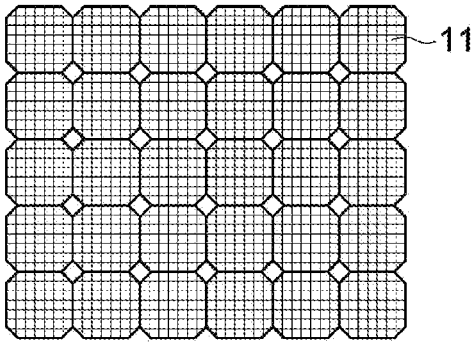

Next, in the method of installing the base isolation floor 7 to which the present invention is applied, in this example, as shown in FIGS. 8C and 8D, the bases 11 are installed on the double-sided tapes 2*a* applied in parallel while being aligned without intervals. The base 11 is installed on the double-sided tapes 2*a* or a seal material and thereby fixed by the adhesive force of the double-sided tapes 2*a* or the seal material, so that movement of the base 11 is suppressed. In the method of installing the base isolation floor 7 to which the present invention is applied, in another example, the double-sided tape 2*a* or the seal material is not coated onto the upper surface 1*a* of the floor 1, and the base 11 may be directly installed on the upper surface 1*a* of the floor 1. According to this constitution, the movement of the base 11 can be suppressed by a friction force between the upper surface 1*a* of the floor 1 and a bottom surface portion 11*b* of the base 11.

Figure 8E:
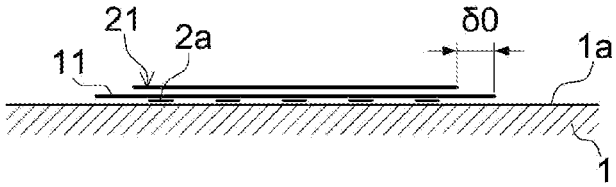
Figure 8F:
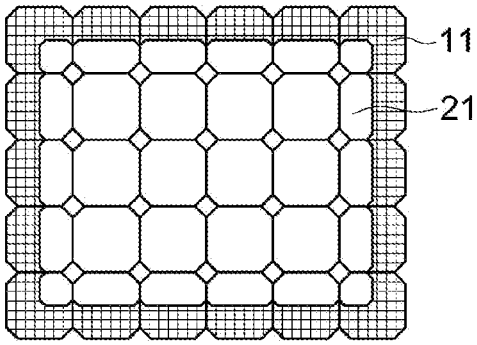

Next, as shown in FIGS. 8E and 8F, the slide plates 21 are aligned and installed on the bases 11. In such a case, the slide plate 21 is installed so that the convex curved surface portions 12 are fitted into the concave curved surface portions 22 or the through-holes 22*a* on the base 11 shown in FIGS. 4C and 4D. At this time, the slide plate 21 may be installed while being setback by a movement margin $\delta_0$ from a peripheral edge of the base 11. When the slide plate 21 is installed while being setback with respect to the base 11, even if the slide plate 21 is moved by vibration of an earthquake to be described later, the slide plate 21 is prevented from being fallen from the base 11 of the peripheral edge of the base isolation floor 7, and displacement of the slide plate 21 can be absorbed.

Even when the slide plate 21 moves beyond a range of the above setback and is fallen from the base 11, the slide plate 21 moves on the upper surface 1*a* of the floor 1 to some extent by inertia and then naturally stops. Thus, when the movement of the slide plate 21 moderately and naturally stops, overturning of precision equipment and the like placed on the slide plate 21 can be avoided.

Figure 9A:
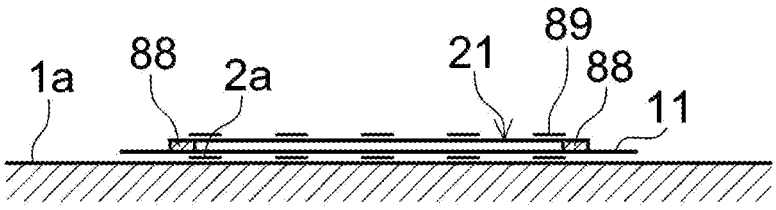
FIGS. 9A and 9B are views showing an example of connection with a tape and the like according to a floor area requiring introduction of the base isolation floor.
Figure 9B:
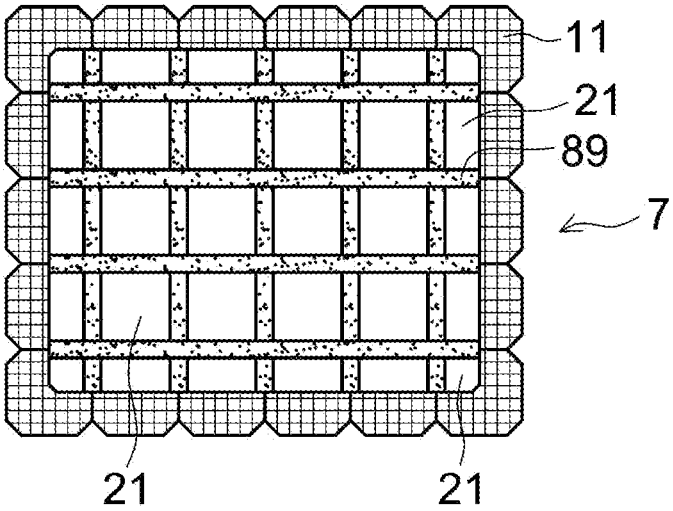

As shown in FIGS. 9A and 9B, the slide plates 21 are used by being connected with a tape 89 or the like according to a floor area requiring introduction of the base isolation floor 7. In another example, the bases 11 may be similarly used by being connected with a seal material such as the tape 89. When the bases 11 and the slide plates 21 are each connected to be integrated, the base 11 and the slide plate 21 are easily positioned, and construction properties of installation can be enhanced. Furthermore, an upper surface of the integrated slide plates 21 can be widely used as the base isolation floor 7. Moreover, the base 11 and the slide plate 21 adjacent to each other can be connected using bolts and the like. As shown in FIGS. 9A and 9B, in order to allow the above setback at the peripheral edge of the base 11, the integrated slide plate 21 at the outermost circumference may have shape and size different from the slide plate provided on the inner circumference side.

Figure 10A:
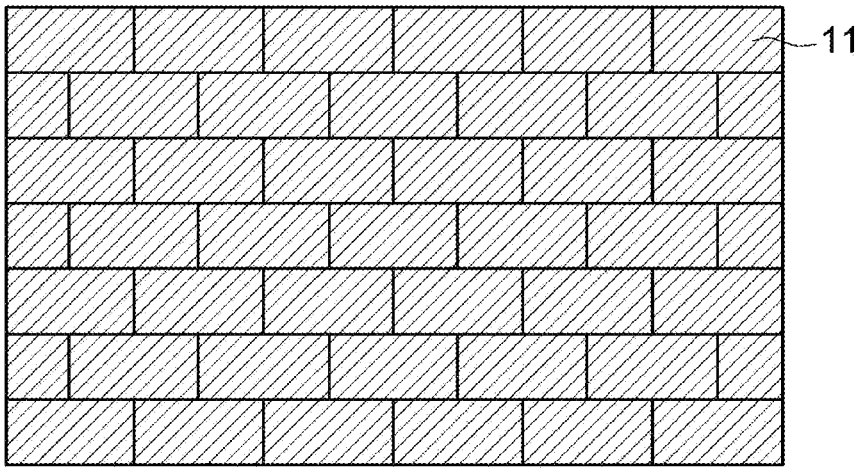
FIG. 10A is a plan view of connected substantially rectangular bases as viewed from above.
Figure 10B:
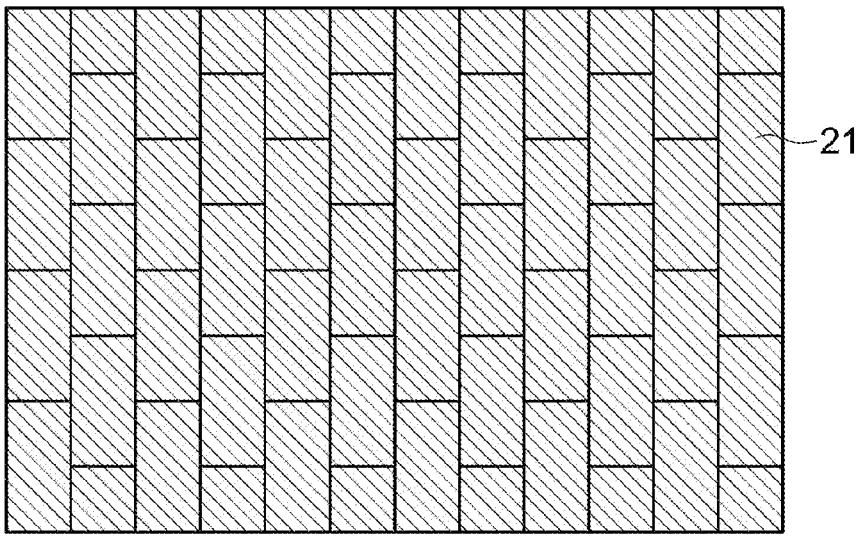
FIG. 10B is a plan view of connected substantially rectangular slide plates as view from above.
Figure 11A:
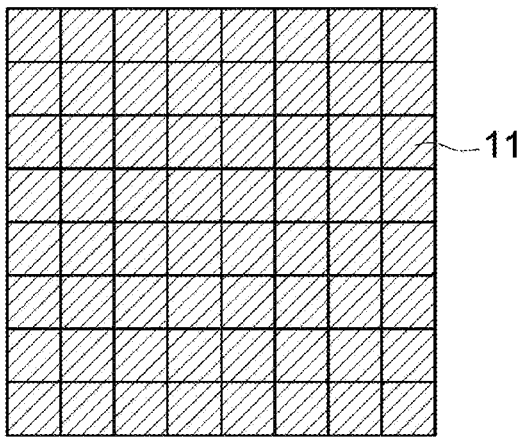
FIG. 11A is a plan view of connected substantially square bases as viewed from above, FIG. 11 B is a plan view of connected slide plates installed on the bases as viewed from above.
Figure 11B:
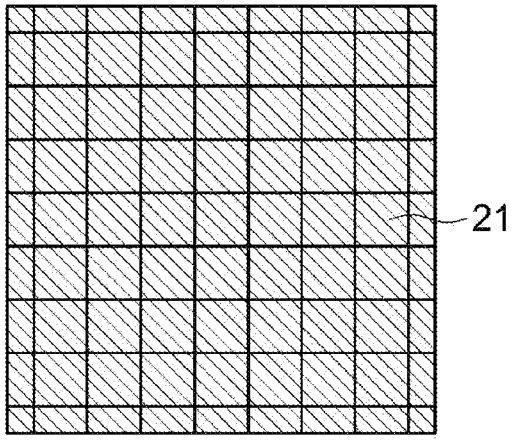
FIG. 11C is a plan view of a state in which the slide plates are installed on the bases as viewed from above.
Figure 11C:
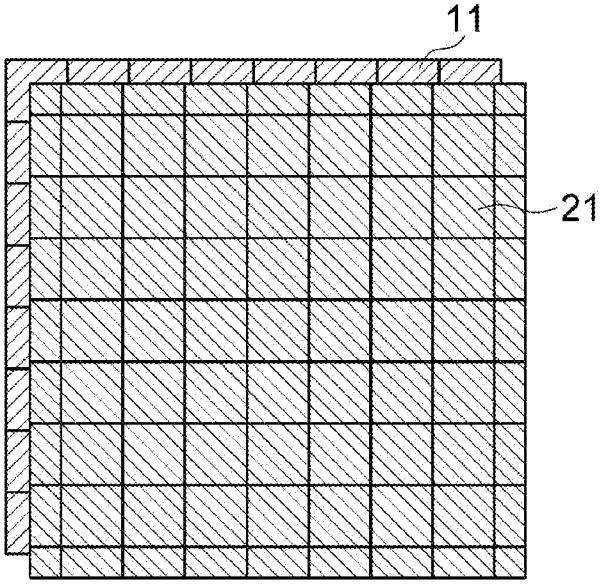

In FIG. 10A, the bases 11 having a substantially rectangular shape and the bases 11 having a substantially square shape are connected, and in FIG. 10B, the slide plate 21 having a substantially rectangular shape and the slide plate 21 having a substantially square shape are connected. In this example, the base 11 and the slide plate 21 are different in the direction of the long side. In FIG. 11A, the bases 11 having a substantially square shape are connected, and in FIG. 11B, the slide plates 21 having a substantially rectangular shape and the small slide plates 21 having a substantially square shape are connected at the outermost circumference of the connected slide plates 21 having a substantially square shape. As shown in FIG. 11C, the slide plate 21 can be installed so that at least two sides in each of the slide plates 21 overlap the inside surrounded by four sides of the bases 11 by approximately ½ of the side length. By virtue of the use of them, each side of the base 11 and each side of the slide plate 21 less likely to overlap in the earthquake motion. Thus, it is possible to avoid collision of the peripheral edge of the slide plate 21 with the peripheral edge of the base 11 due to turning-up of the base 11. In this case, the amplitude (movable distance) of a scenario earthquake is not more than ½ of the side length. When the amplitude of the scenario earthquake is 250 mm, the side length is required to be not less than 500 mm.

Figure 12:
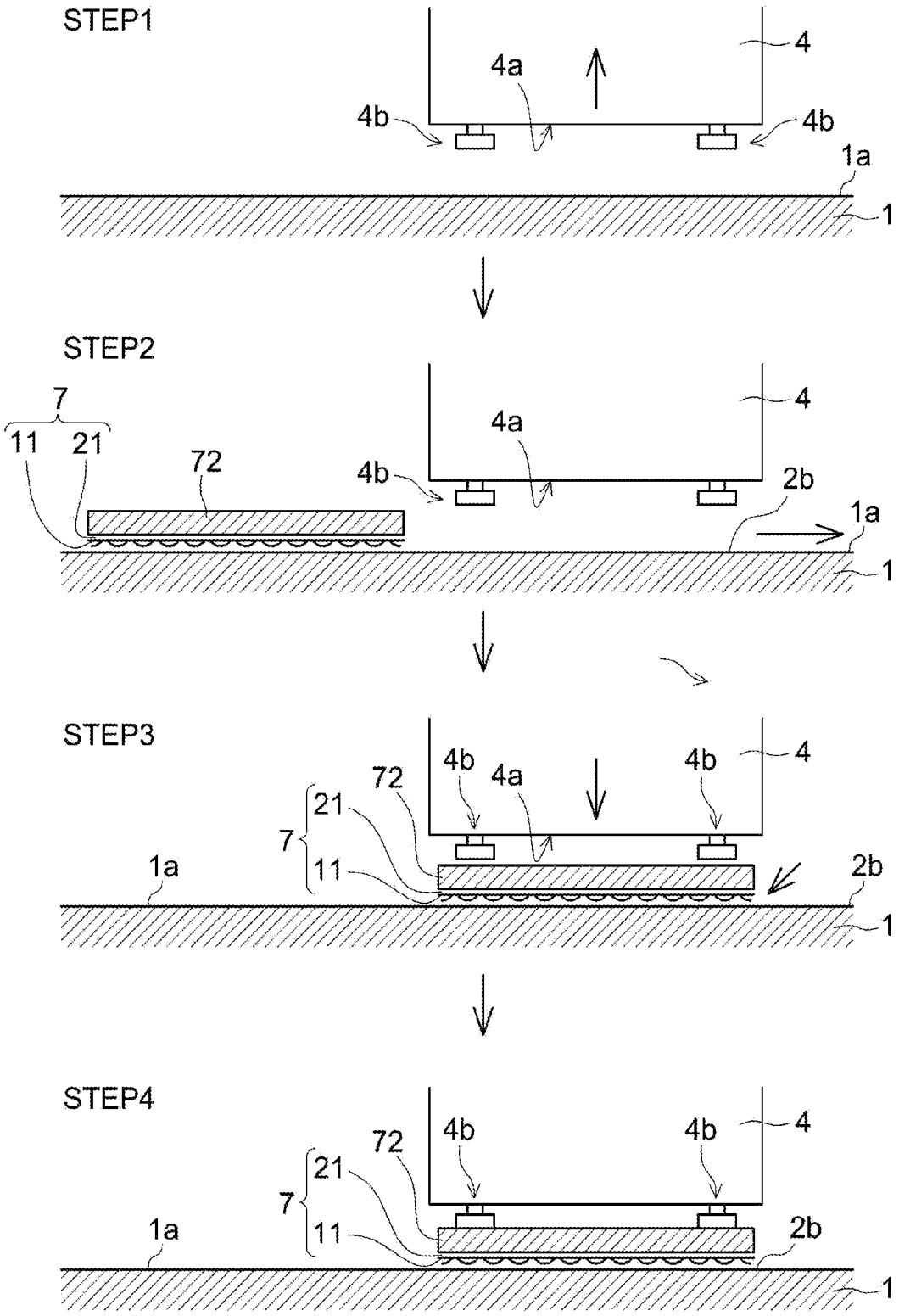
FIG. 12 is a view showing an example in which the base isolation floor is installed using a nonslip sheet having a high friction force instead of a double-sided tape.

In the method of installing the base isolation floor 7 to which the present invention is applied, in another example, instead of the double-sided tape 2*a*, a nonslip sheet 2*b* having a friction force higher than that of the upper surface 1*a* of the floor 1 can be used, as shown in FIG. 12. As a method of using the nonslip sheet 2*b*, first, in STEP 1, equipment 4 is jacked up, for example, a foot portion 4*b* of the equipment 4 is spaced apart from the upper surface 1*a* of the floor 1 at intervals not less than the thickness of the nonslip sheet 2*b*, the base isolation floor 7, and a thick plate 72. Next, in STEP 2, the base isolation floor 7 and the thick plate 72 are placed on the nonslip sheet 2*b*, and the nonslip sheet 2*b* is pulled in the arrow direction in the drawing, whereby the base isolation floor 7 and the thick plate 72 are slid in between the upper surface 1*a* of the floor 1 and a bottom portion 4*a* of the equipment 4, and the base isolation floor 7 is fixed to the upper surface la of the floor 1 by a friction force with the nonslip sheet 2*b*.

Next, in STEP 3, the nonslip sheet 2*b* is cut at a boundary with a portion laid under the base isolation floor 7. Finally, in STEP 4, the equipment 4 is installed on the base isolation floor 7 and the thick plate 72. In the method using the nonslip sheet 2*b*, even when the base isolation floor 7 is applied to the existing equipment 4, the base isolation floor 7 can be slid in between only by slightly lifting up the bottom portion 4*a* of the equipment 4, and massive movement of the equipment 4 is not required. Thus, particularly in a case where a large power is required to lift the equipment 4 because the weight of the equipment 4 is large, the base isolation floor 7 can be installed more efficiently. It should be noted that the nonslip sheet 2*b* coated on its surface with resin into a granular state may be used. According to this constitution, the sliding property can be controlled by adjusting the friction force between the nonslip sheet 2*b* and the upper surface 1*a* of the floor 1 produced when the nonslip sheet 2*b* is actually pulled, and the friction coefficient can be increased to prevent the base isolation floor 7 installed on the nonslip sheet 2*b* from shifting easily during pulling work.

Moreover, the nonslip sheet 2*b* can be used as a substitute for the double-sided tapes 2*a* shown in FIGS. 8A-8F by being spread all over the upper surface 1*a* of the floor 1 on which the base isolation floor 7 is installed. Furthermore, the nonslip sheet 2*b* includes a sheet coated on its surface with olefin elastomer resin into a granular state and a sheet adhered on its surface with, for example, silicon carbide granules, glass sand granules, or white alumina granules.

Figure 13:
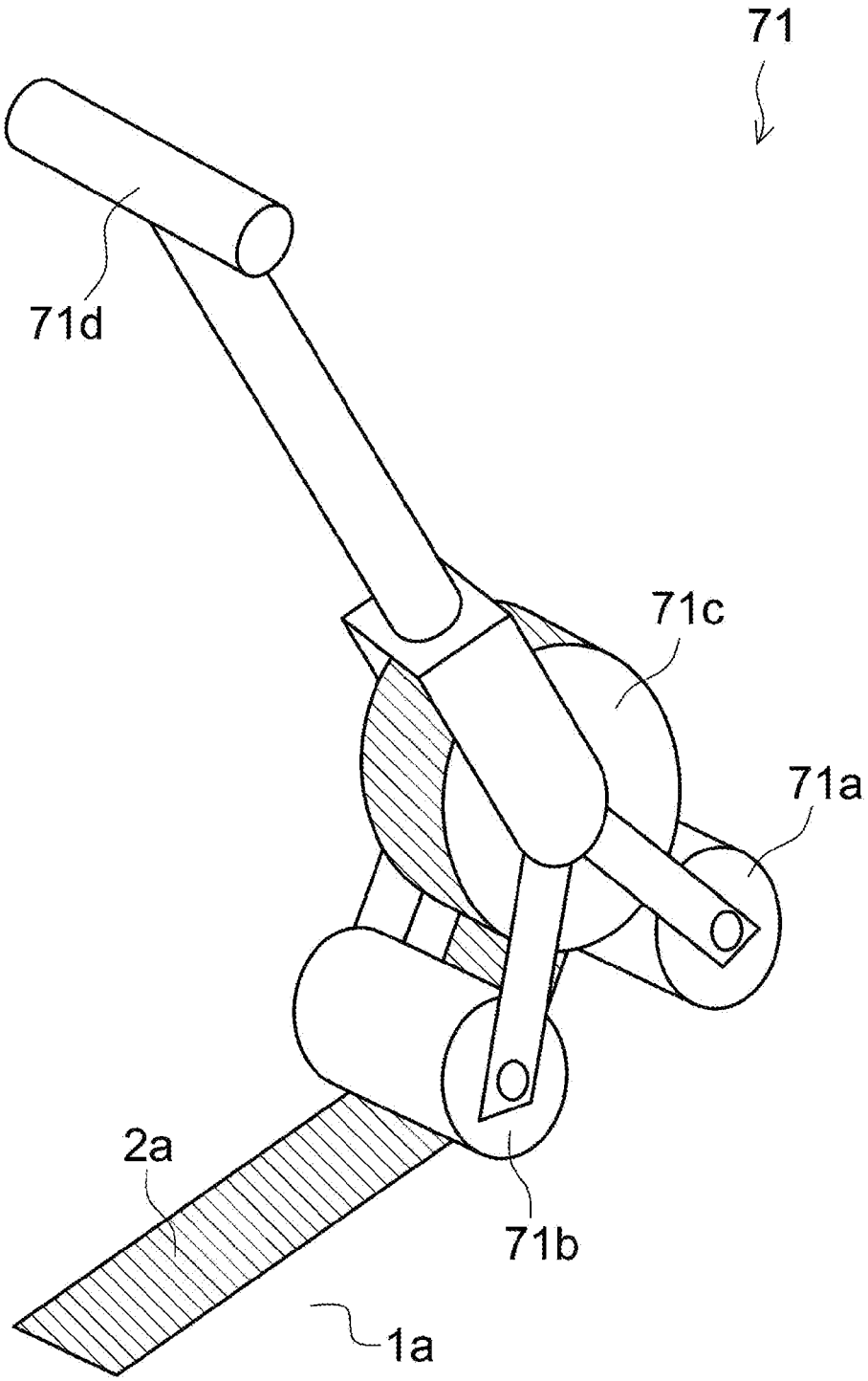
FIG. 13 is a view for explaining a dedicated roller having a heating roller for preheating at its front wheel and a heating roller for press-fitting at its rear wheel.

Furthermore, in the method of installing the base isolation floor 7 to which the present invention is applied, in another example, when this method is used in a low temperature space of not more than 0° C., such as a freezer, a water absorbing cloth can be used instead of the double-sided tape 2*a*. The water absorbing cloth can be adhered to the upper surface 1*a* of the floor 1 by being frozen in the low temperature space. In another example, when the double-sided tape 2 is applied in the low temperature space of not more than 0° C., such as a freezer, a roller for use in refrigerating chamber 71 having a heating roller for preheating 71*a* at its front wheel and a heating roller for press-fitting 71*b* at its rear wheel may be used, as shown in FIG. 13. In this example, the double-sided tape 2*a* is fed from a winding portion 71*c* while a handle 71*d* is pushed by a hand, and the double-sided tape 2*a* can be adhered to the upper surface 1*a* of the floor 1, heated by the heating roller for preheating 71*a* provided at its front wheel, while being pressed by the heating roller for press-fitting 71*b* provided at its rear wheel, so that the double-sided tape 2*a* can be applied onto the floor 1 even in the low temperature space.

Figure 14:
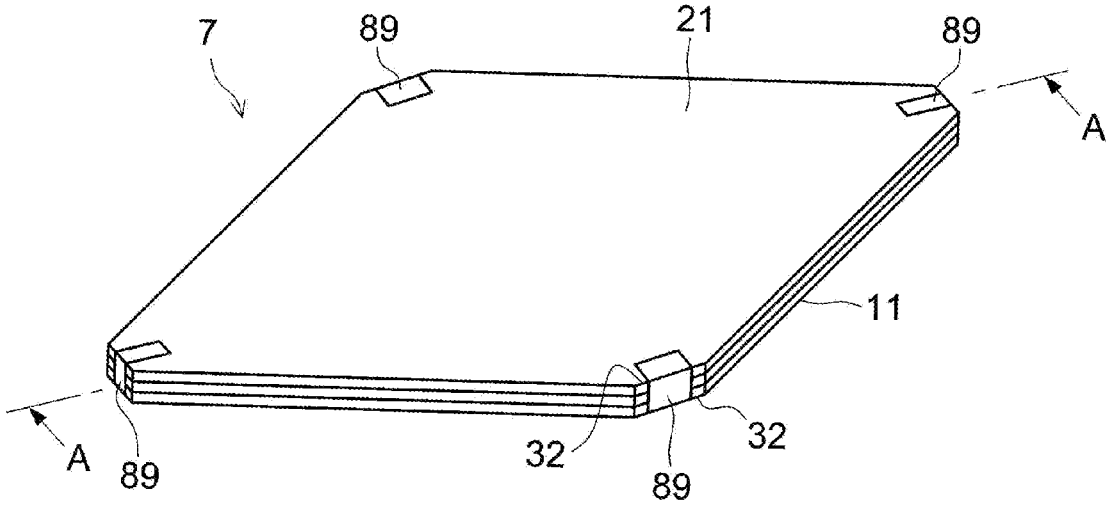
FIG. 14 is a view showing an example in which the base and the slide surface are integrated by applying tapes on chamfered portions in a state of being closely adhered to each other.

The four corners of the base 11 and the slide plate 21 are chamfered, as shown in FIG. 14, and thus, the tape 89 is applied to a chamfered portion 32 while the base 11 and the slide plate 21 are closely adhered to each other, whereby the base 11 and the slide plate 21 can be carried while being integrated with each other. According to this constitution, since the base 11 and the slide plate 21 are conveyed while being closely adhered to each other, there is little to no gap between the base 11 and the slide plate 21, and it is possible to prevent dust from being adhered to between the base 11 and the slide plate 21. The tape 89 is peeled when the base 11 and the slide plate 21 are installed on the floor 1, and the peeled tape 89 is reusable in the connection between the adjacent bases 11 or the adjacent slide plates 21, so that smooth connecting operation becomes possible.

When the base 11 is formed of synthetic resin, a hardener 87 can be filled into the convex curved surface portion 12 shown in FIGS. 15A-15D, whereby the compressive strength of the convex curved surface portion 12 can be enhanced. In the convex curved surface portion 12, the raised portion 12*b* is formed outside of the concentric circle, as shown in FIG. 5C, whereby even if distortion occurs during processing, the raised portion 12*b* is freely elastically deformed to thereby allow absorption of the distortion.

Figure 15A:
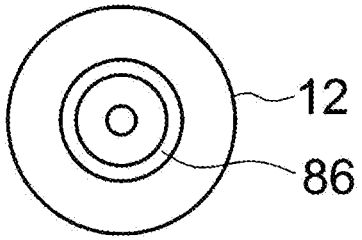
FIGS. 15A-15D are views for explaining another constitutional example of the convex curved surface portion.
Figure 15B:
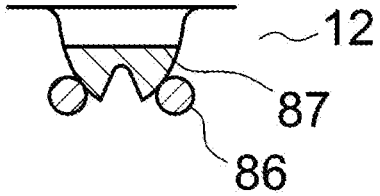
Figure 15C:
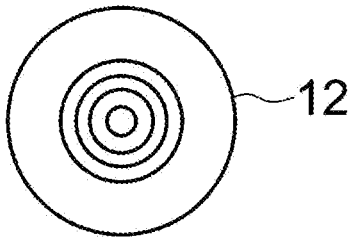
Figure 15D:
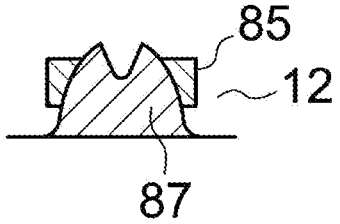

As shown in FIGS. 15C and 15D, the inside of the convex curved surface portion 12 may be filled with the hardener 87. According to this constitution, a sufficient supporting force can be held. Furthermore, in this example, a foam 85 is fitted in around the convex curved surface portion 12. According to this constitution, a lubricant is stored, and a sliding performance can be stabilized. Moreover, in the top surface of the convex curved surface portion 12, a minute recessed portion is previously provided, whereby oil may be filled in the recessed portion. The oil can be coated onto the lower surface portion 21*b* of the slide plate 21 through the top surface of the convex curved surface portion 12, so that a coefficient of dynamic friction between the slide plate 21 and the base 11 can be naturally adjusted.

The slit 12*c* is inserted into the outer circumference of the convex curved surface portion 12, as shown in FIGS. 6A and 6B, whereby an internal stress produced when the convex curved surface portions 12 are press-molded can be released from the slit 12*c*. According to this constitution, in the present invention, the convex curved surface portion 12 can be formed with high accuracy. When the through-hole 22*a* is formed, a punching tool is used in the processing, whereby a smooth cut surface can be formed. The slide plate 21 is formed at its peripheral edge with a taper portion 84, as shown in FIG. 2A, whereby the sliding performance at the peripheral edge portion can be further enhanced.

The convex curved surface portions 12 are arranged while being aligned vertically and horizontally or arranged in a zigzag pattern, whereby sliding of the slide plate 21 can be smoothed, and moreover, a load applied from the equipment 4 is uniformized, so that stable sliding can be realized in such a state that the equipment 4 is placed on the slide plate 21. A lubricant is previously coated between the base 11 and the slide plate 21, whereby the sliding of the slide plate 21 is smoothed, and, at the same time, an effect of attenuating the vibration of an earthquake can be exercised.

A static friction coefficient between the concave curved surface portions 22 and the convex curved surface portion 12 fitted into the concave curved surface portions 22 depends on the depth of fitting and is set to 0.10 to 0.40, for example, whereby when no earthquake occurs, the movement of the slide plate 21 can be strongly suppressed. Thus, the equipment 4 placed on the base isolation floor 7 can be prevented from being easily moved by such a slight impact that a person knocks against the equipment 4 when no earthquake occurs. In another example, even in the through-hole 22*a* shown in FIG. 4D and the high friction portion 22*b* shown in FIGS. 4A and 4B, the above static friction coefficient is set to 0.10 to 0.40, for example so as to depend on the size of the through-hole 22*a*, whereby it is possible to prevent the slide plate 21 from being moved when no earthquake occurs as in the case where the concave curved surface portion 22 shown in FIG. 4C is formed.

Since the convex curved surface portion 12 has an upward convex shape, dust to be adhered to the base isolation floor 7 is fallen from the convex curved surface portion 12 by gravity. Thus, the base isolation floor 7 can prevent the above static friction coefficient from being reduced by the fact that dust is held between the convex curved surface portion 12 and the concave curved surface portion 22.

In this example, the sliding portion 23 formed with no concave curved surface portion 22 is set low so that the coefficient of dynamic friction generated when the convex curved surface portion 12 is abutted against the sliding portion 23 is approximately 0.04. Thus, when the vibration of an earthquake is more than a static friction force between the convex curved surface portion 12 and the concave curved surface portion 22, and when the fitting state between the convex curved surface portion 12 and the concave curved surface portion 22 is released, the slide plate 21 can smoothly slide between the convex curved surface portion 12 and the sliding portion 23. According to this constitution, the base isolation floor 7 according to the present invention, when an earthquake occurs, the slide plate 21 slides against the base 11, whereby the vibration of the earthquake can be absorbed. Regarding the coefficient of dynamic friction, the surface layer of the convex curved surface portion 12 is covered with a hard material such as metal and ceramics or additionally subjected to surface hardening treatment such as carburizing treatment and boronizing, whereby the coefficient of dynamic friction can be set lower, so that a stabilized sliding performance can be obtained.

As shown in FIG. 9A, a water stop material 88 such as a seal material, a grease in a sol or gel state, and wax may be filled in between the base 11 and the slide plate 21. Consequently, intrusion of water and dust into between the base 11 and the slide plate 21 is prevented, and the base isolation floor 7 can be prevented from being oxidized and corroded. The water stop material 88 is provided at the peripheral edge of the slide plate 21, whereby it is possible to strongly suppress intrusion of rainwater and the like. Furthermore, between the base 11 and the slide plate 21, an outermost circumference 7*a* of the base isolation floor 7 is sealed and tightly closed, and the existing inner air is replaced with an inert gas such as nitrogen gas and argon gas, whereby the base 11 and the slide plate 21 formed mainly of metal can be prevented from being oxidized by air, so that the base isolation floor 7 can be prevented from being oxidized and corroded. Moreover, the surface layers of the base 11 and the slide plate 21 are covered with polyethylene or the like, whereby chemical resistance against sulfuric acid, hydrochloric acid, aqua regia and the like can be enhanced.

Figure 16A:
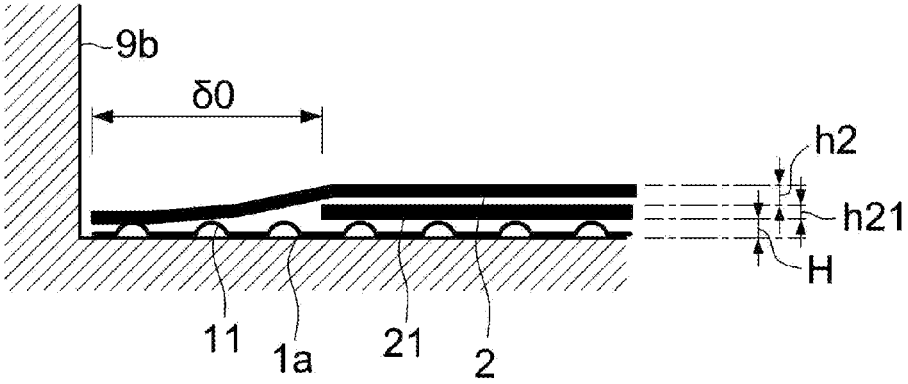
FIGS. 16A-16C are side views showing a detailed configuration when a slide plate is installed.
Figure 16B:
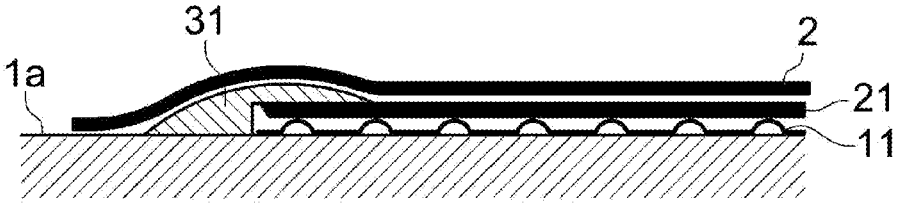
Figure 16C:
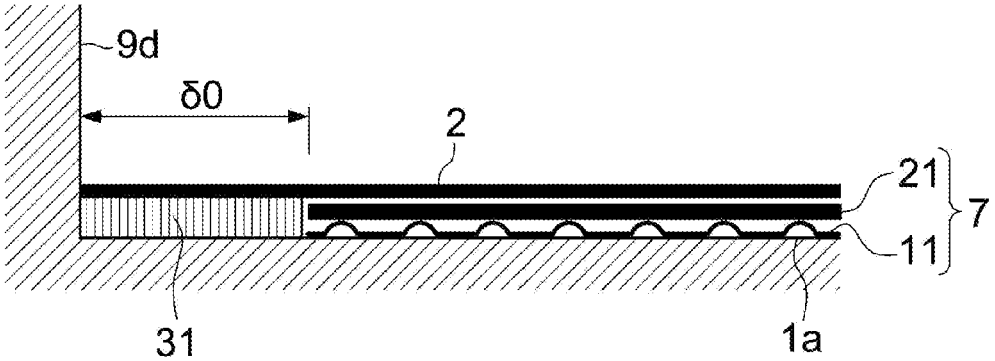

When the slide plate 21 is installed while being setback, since the upper surface 1*a* of the floor 1, the upper surface portion 11*a* of the base 11, and the slide plate 21 are installed in a stepwise manner, as shown in FIG. 16A, a step between the upper surface 1*a* of the floor 1 and the slide plate 21 is gentle in comparison with a case where setback is not performed. Thus, getting on and off of a carriage and the like on the floor 1 installed with no base isolation floor 7 and the base isolation floor 7 can be smoothed. In another example, when setback is not performed, a step elimination member 31 may be installed, as shown in FIG. 16B. As shown in FIG. 16C, a buffer member vertically formed with a plurality of honeycomb-shaped cylindrical portions or an elastic member formed of rubber, synthetic resin, or the like is used as the step elimination member 31, whereby a step can be eliminated, and, at the same time, impact due to the movement of the slide plate 21 can be absorbed.

Figure 17A:
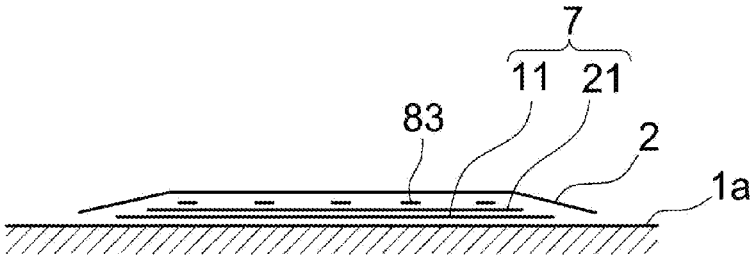
FIGS. 17A and 17 B are views for explaining an installation example of a protective sheet.
Figure 17B:
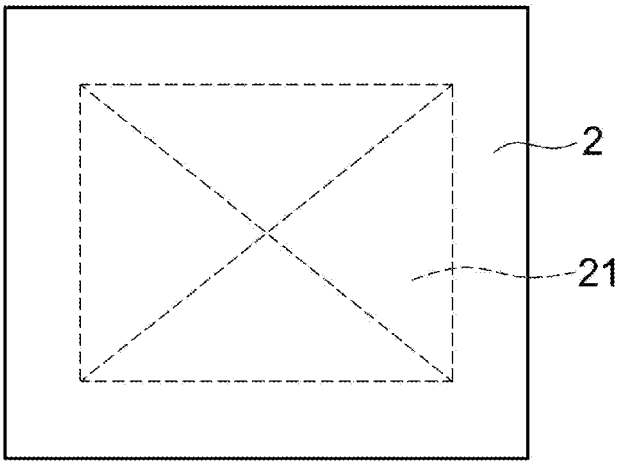
Figure 18:
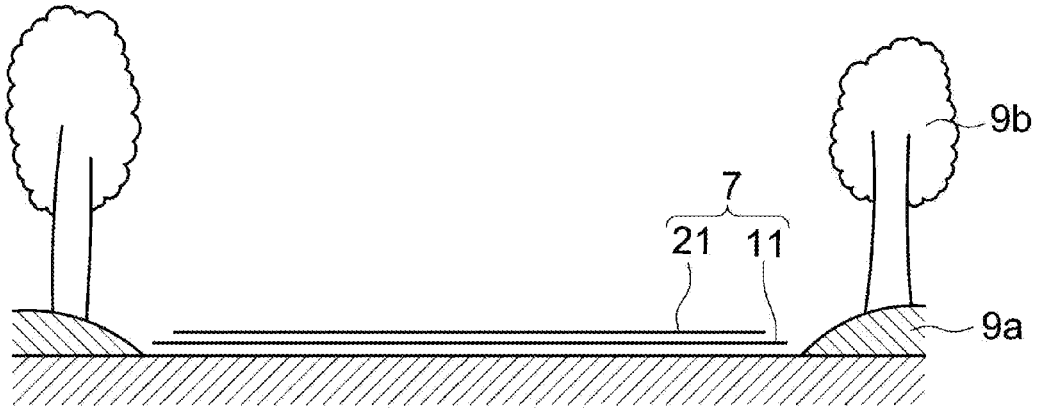
FIG. 18 is a view showing an example in which banking and trees are arranged to surround a peripheral edge of the base isolation floor.

A protective sheet 2 is installed on the slide plate 21 while covering the base isolation floor 7, as shown in FIGS. 17A and 17B. The protective sheet 2 may be mounted on the slide plate 21 through an adhesive portion 83 formed of a thermosetting resin such as epoxy or another material having elasticity. According to this constitution, the protective sheet 2 can be installed while being integrated with the slide plate 21, and construction properties of the installation of the slide plate 21 and the protective sheet 2 can be enhanced. Furthermore, the protective sheet 2 is installed in an area larger than the base isolation floor 7, whereby the base 11 and the slide plate 21 are completely covered with the protective sheet 2 and thereby configured not to be directly exposed outside, so that it is possible to prevent intrusion of dust from outside into between the base 11 and the slide plate 21 and enhance the durability of the base isolation floor 7. In the base isolation floor 7 according to the present invention, banking 9*a*, trees 9*b*, and the like are arranged surrounding the peripheral edge of the base isolation floor 7, as shown in FIG. 18, whereby the slide plate 21 can be prevented from being fallen from the base 11 constituting the peripheral edge of the base isolation floor 7.

In the thickness of the base isolation floor 7 obtained by stacking the double-sided tape 2*a*, the base 11, the slide plate 21, and the protective sheet 2, a thickness H of the base 11 is 1.5 mm, a thickness $h_{21}$ of the slide plate 21 is 1.6 mm, and a thickness $h_2$ of the protective sheet 2 is approximately 2.0 mm, as shown in FIG. 16A, and therefore, the total thickness of the base isolation floor 7 is so thin as approximately 5.0 mm.

Since the thickness $h_{21}$ of the slide plate 21 is so small as 1.6 mm, even when the slide plate 21 is installed while being setback with respect to the base 11, as shown in FIG. 16A, the step between the slide plate 21 and the base 11 can be reduced. At this time, since the thickness H of the base 11 is so small as 1.5 mm, a step between the base 11 and the floor 1 can be reduced. Furthermore, the thickness of the slide plate 21 is so small as 1.6 mm, and therefore, even when the slide plate 21 is fallen from the base 11 and collides with a wall surface 9*d*, the slide plate 21 can be easily buckled, so that impact due to the collision can be absorbed by hysteresis due to buckling of the slide plate 21. Thus, the base isolation floor 7 can prevent overturning of the equipment 4 and the like installed thereon.

In the base isolation floor 7 according to the present invention, as shown in FIGS. 7A and 7B, in the bottom surface portion 11*b* of the base 11, an elastic plate 2*d* which is to be just put on a floor surface without being adhered and fixed to the floor surface and is formed of synthetic rubber or the like can be installed. According to this constitution, the base isolation floor 7 can absorb not only horizontal external force due to an earthquake or the like but also vertical external force. The elastic plate 2*d* can be installed on the upper surface portion 21*c* of the slide plate 21. Concrete (not shown) can be placed on the base isolation floor 7 shown in FIG. 1. Instead of placement of concrete, a floor plate formed of precast concrete (not shown) is installed, and the base isolation floor 7 and the floor plate can be joined by bolts or the like. Accordingly, increase of the height of the floor surface, on which the base isolation floor 7 is installed, due to the installation of the base isolation floor 7 is suppressed, and a wide effective space in a building can be secured. Since the thickness of the base isolation floor 7 is small, the base isolation floor 7 can be installed while the bottom portion 4*a* of the existing equipment 4 is lifted as shown in FIG. 12.

Figure 19:
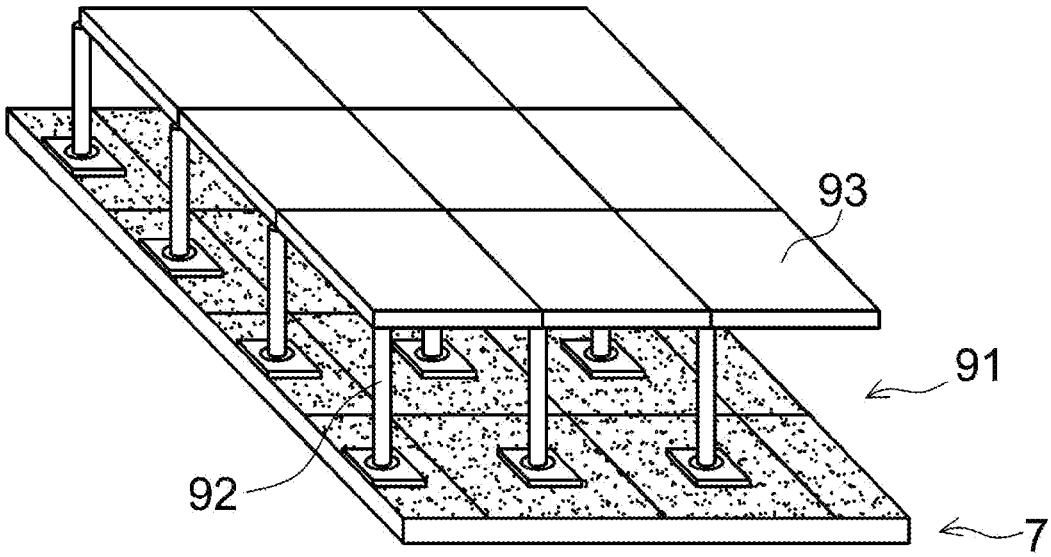
FIG. 19 is a view for explaining an example in which an OA floor is formed.

In the base isolation floor 7 according to the present invention, as shown in FIG. 19, a support member 92 is installed in the upper portion, a gap 91 is provided between the support member 92 and a floor material 93, and an OA floor can be formed. In a place where a precision machine such as server, requiring prevention of overturning is installed, particularly the base isolation floor 7 according to the present invention exercises an effect as a base isolation device.

Figure 20A:
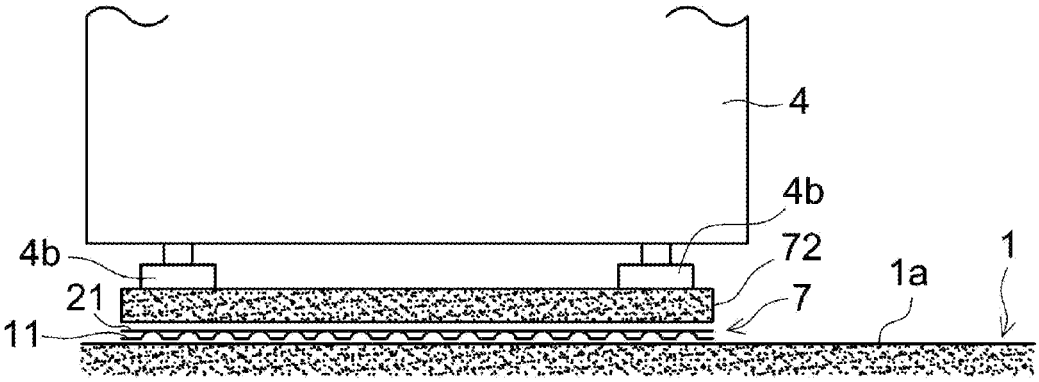
FIGS. 20A and 20B are views for explaining another installation example of the base isolation floor according to the present invention.
Figure 20B:
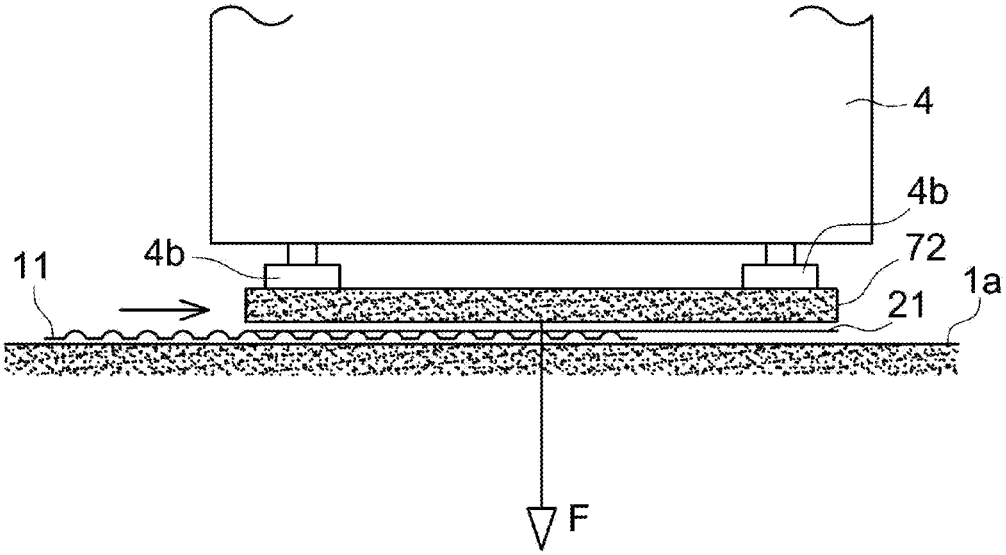

The base isolation floor 7 according to the present invention is installed not only on the entire floor 1 but, as shown in FIG. 20A, may be installed intensively only on the bottom portion 4*a* of the specific equipment 4. According to this constitution, in the base isolation floor 7 according to the present invention, cost required for installation thereof can be suppressed in comparison with the case where the base isolation floor 7 is installed on the entire floor 1. Furthermore, in the equipment 4 having the foot portion 4*b*, the thick plate 72 formed of steel, wood, or the like may be disposed between the slide plate 21 and the foot portion 4*b*, as shown in FIG. 20A. According to this constitution, as shown in FIG. 20B, the center of gravity of the equipment 4 through the thick plate 72 can be located as above the base 11 as possible, and if the equipment 4 is on (within the range of) the base 11 along with the slide plate 21, the slide plate 21 is not fallen from above the base 11, and the base isolation function can be exercised.

Hereinabove, although the examples of the present invention have been described in detail, the above examples are merely examples of the embodiment for carrying out the invention, and the technical range of the present invention should not be limited to only these examples.

For example, in the base isolation floor 7 according to the present invention, the slide plate 21 is installed on the floor 1 so that the concave curved surface portion 22 is directed upward, and the base 11 may be installed on the slide plate 21 so that the convex curved surface portion 12 is directed downward. FIG. 15A shows a bottom view of the convex curved surface portion 12 protruded to be directed downward, and FIG. 15B shows a side view of the convex curved surface portion 12. An O-ring 86 is fitted into the convex curved surface portion 12. In this case, the hardener 87 may be supplied into the convex curved surface portion 12 installed to be directed downward. When the O-ring 86 is formed of synthetic rubber, for example, the friction coefficient with respect to the slide plate 21 can be adjusted.

REFERENCE SIGNS LIST

1 Floor
1*a* Upper surface of floor
2 Protective sheet
2*a* Double-sided tape
2*b* Nonslip sheet
2*c* Water absorbing cloth
2*d* Elastic plate
4 Equipment
4*a* Bottom portion of equipment
4*b* Foot portion of equipment
7 Base isolation floor
7*a* Outermost circumference of base isolation floor
9*a* Banking
9*b* Tree
11 Base
11*a* Upper surface portion of base
11*b* Bottom surface portion of base
12 Convex curved surface portion
12*a* Top portion
12*b* Raised portion
12*c* Slit
12*d* O-ring
21 Slide plate
21*a* Lower surface portion of slide plate
21*b* Taper portion
21*c* Upper surface portion of slide plate
22 Concave curved surface portion
22*a* Through-hole
22*b* High friction portion
22*c* Oil
23 Slide portion
31 Step elimination member
32 Chamfered portion
71 Roller for use in refrigerating chamber
71*a* Heating roller for preheating
71*b* Heating roller for press-fitting
72 Thick plate
84 Taper portion
85 Foam
86 O-ring
87 Hardener
88 Water stop material
89 Tape
91 Gap
92 Support member
93 Floor material

The invention claimed is:

1. A method of installing a base isolation floor, the method comprising:

installing a plurality of plate-shaped bases on a nonslip sheet which is placed on a floor surface, wherein the nonslip sheet has a friction coefficient larger than that of the floor surface, and wherein the plurality of bases have a plurality of upward convex curved surface portions aligned on upper surfaces thereof;

installing a plurality of plate-shaped slide plates, each having a substantially flat lower surface, on the bases such that the slide plates are movable by an earthquake motion; and pulling an end of the nonslip sheet to slide the nonslip sheet along the floor surface to position the slide plates and the bases beneath a bottom portion of a piece of equipment, and installing the piece of equipment onto the slide plates;

wherein the bases and the slide plates are installed such that a slide plate among the slide plates is movable by the earthquake motion to be dropped from above the bases onto the floor surface around the bases, and moved on the floor surface by inertia to be decelerated and stopped.

2. A method of installing a base isolation floor, the method comprising:

installing a plurality of plate-shaped bases on double-sided tapes applied onto a floor surface and thereby arranging the bases on the floor surface, wherein the double-sided tapes are arranged on the floor surface in a plurality of columns to be substantially parallel to each other, and wherein the plurality of bases have a plurality of upward convex curved surface portions aligned on upper surfaces thereof; and installing a plurality of plate-shaped slide plates, each having a substantially flat lower surface, on the bases such that the slide plates are movable by an earthquake motion, wherein the bases and the slide plates are installed such that a slide plate among the slide plates is movable by the earthquake motion to be dropped from above the bases onto the floor surface around the bases, and moved on the floor surface by inertia to be decelerated and stopped; and wherein the method further comprises, when installing the bases in a space with a room temperature of not more than 0° C., preheating the floor surface using a forward first heating roller, and applying and press-fitting the double-sided tape onto the preheated floor surface using a second heating roller which is arranged rearward of the forward first heating roller.

3. The method according to claim 2, wherein each of the bases has a thickness of 1.5 mm.

4. The method according to claim 2, wherein a lower surface of each of the slide plates is coated with a lubricant at a portion not abutted against the convex curved surface portions of the bases in a state in which the slide plates are installed on the bases.

5. The method according to claim 2, wherein after the slide plates are installed on the bases, a thick plate is further installed on the slide plates.

6. A method of installing a base isolation floor, the method comprising:

installing a plurality of plate-shaped bases on double-sided tapes applied onto a floor surface and thereby arranging the bases on the floor surface, wherein the double-sided tapes are arranged on the floor surface in a plurality of columns to be substantially parallel to each other, and wherein the plurality of bases have a plurality of upward convex curved surface portions aligned on upper surfaces thereof; and installing a plurality of plate-shaped slide plates, each having a substantially flat lower surface, on the bases such that the slide plates are movable by an earthquake motion, wherein the bases and the slide plates are installed such that a slide plate among the slide plates is movable by the earthquake motion to be dropped from above the bases onto the floor surface around the bases, and moved on the floor surface by inertia to be decelerated and stopped, and wherein after the slide plates are installed on the bases, the bases and a peripheral edge of the slide plates are sealed, and air of a gap between the bases and the slide plates is replaced with an inert gas.

7. The method according to claim 2, further comprising:

installing a plurality of support members on the slide plates installed on the bases without connecting the support members mutually, and installing a floor material on the support members, thereby forming a gap between the slide plates and the floor material and thereby installing an Over and Above (OA) floor.

8. The method according to claim 6, wherein each of the bases has a thickness of 1.5 mm.

9. A method of installing a base isolation floor, the method comprising:

installing a plurality of plate-shaped bases on an adhesive layer coated onto a floor surface and thereby arranging the bases on the floor surface, wherein the plurality of bases have a plurality of upward convex curved surface portions aligned on upper surfaces thereof; and installing a plurality of plate-shaped slide plates, each having a substantially flat lower surface, on the bases such that the slide plates are movable by an earthquake motion, wherein the bases and the slide plates are installed such that a slide plate among the slide plates is movable by the earthquake motion to be dropped from above the bases onto the floor surface around the bases, and moved on the floor surface by inertia to be decelerated and stopped, and wherein after the slide plates are installed on the bases, the bases and a peripheral edge of the slide plates are sealed, and air of a gap between the bases and the slide plates is replaced with an inert gas.

10. The method according to claim 1, wherein each of the bases has a thickness of 1.5 mm.

11. The method according to claim 6, wherein a lower surface of each of the slide plates is coated with a lubricant at a portion not abutted against the convex curved surface portions of the bases in a state in which the slide plates are installed on the bases.

12. The method according to claim 9, wherein a lower surface of each of the slide plates is coated with a lubricant at a portion not abutted against the convex curved surface portions of the bases in a state in which the slide plates are installed on the bases.

13. The method according to claim 1, wherein a lower surface of each of the slide plates is coated with a lubricant at a portion not abutted against the convex curved surface portions of the bases in a state in which the slide plates are installed on the bases.

14. The method according to claim 6, wherein after the slide plates are installed on the bases, a thick plate is further installed on the slide plates.

15. The method according to claim 9, wherein after the slide plates are installed on the bases, a thick plate is further installed on the slide plates.

16. The method according to claim 1, wherein after the slide plates are installed on the bases, a thick plate is further installed on the slide plates.

17. The method according to claim 9, wherein each of the bases has a thickness of 1.5 mm.

18. A method of installing a base isolation floor, the method comprising:

installing a plurality of plate-shaped bases on a nonslip sheet which is placed on a floor surface, wherein the nonslip sheet has a friction coefficient larger than that of the floor surface, and wherein the plurality of bases have a plurality of upward convex curved surface portions aligned on upper surfaces thereof; and installing a plurality of plate-shaped slide plates, each having a substantially flat lower surface, on the bases such that the slide plates are movable by an earthquake motion, wherein the bases and the slide plates are installed such that a slide plate among the slide plates is movable by the earthquake motion to be dropped from above the bases onto the floor surface around the bases, and moved on the floor surface by inertia to be decelerated and stopped, and wherein after the slide plates are installed on the bases, the bases and a peripheral edge of the slide plates are sealed, and air of a gap between the bases and the slide plates is replaced with an inert gas.

19. The method according to claim 1, wherein after the slide plates are installed on the bases, the bases and a peripheral edge of the slide plates are sealed, and air of a gap between the bases and the slide plates is replaced with an inert gas.

20. The method according to claim 6, further comprising: installing a plurality of support members on the slide plates installed on the bases without connecting the support members mutually, and installing a floor material on the support members, thereby forming a gap between the slide plates and the floor material and thereby installing an OA floor.

21. The method according to claim 9, further comprising: installing a plurality of support members on the slide plates installed on the bases without connecting the support members mutually, and installing a floor material on the support members, thereby forming a gap between the slide plates and the floor material and thereby installing an OA floor.

22. The method according to claim 1, further comprising: installing a plurality of support members on the slide plates installed on the bases without connecting the support members mutually, and installing a floor material on the support members, thereby forming a gap between the slide plates and the floor material and thereby installing an OA floor.

23. The method according to claim 18, wherein each of the bases has a thickness of 1.5 mm.

24. The method according to claim 18, wherein a lower surface of each of the slide plates is coated with a lubricant at a portion not abutted against the convex curved surface portions of the bases in a state in which the slide plates are installed on the bases.

25. The method according to claim 18, wherein after the slide plates are installed on the bases, a thick plate is further installed on the slide plates.

* * * * *